US007878252B2

(12) United States Patent
Smith et al.

(10) Patent No.: US 7,878,252 B2
(45) Date of Patent: Feb. 1, 2011

(54) DUAL CONTROL LINE SYSTEM AND METHOD FOR OPERATING SURFACE CONTROLLED SUB-SURFACE SAFETY VALVE IN A WELL

(75) Inventors: Roddie R. Smith, Cypress, TX (US); Richard C. Jones, Lafayette, LA (US); Stuart M. Dennistoun, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 626 days.

(21) Appl. No.: 11/841,511

(22) Filed: Aug. 20, 2007

(65) Prior Publication Data

US 2009/0050333 A1 Feb. 26, 2009

(51) Int. Cl.
*E21B 34/10* (2006.01)

(52) U.S. Cl. ..... 166/375; 166/319

(58) Field of Classification Search ..... 166/374, 166/375, 316, 319; 137/802; 138/42; 251/12, 251/14, 57

See application file for complete search history.

(56) References Cited

U.S. PATENT DOCUMENTS

| | | | | |
|---|---|---|---|---|
| 15,376 | A * | 7/1856 | Humphrey | 138/42 |
| 3,598,238 | A * | 8/1971 | Collins, Jr. | 210/138 |
| 4,065,094 | A * | 12/1977 | Adams | 251/26 |
| 4,621,695 | A | 11/1986 | Pringle | |
| 4,667,736 | A * | 5/1987 | Rumbaugh et al. | 166/66.6 |
| 4,791,991 | A * | 12/1988 | Morris et al. | 166/319 |

FOREIGN PATENT DOCUMENTS

| | | |
|---|---|---|
| EP | 1 241 322 A1 | 9/2002 |
| GB | 2 419 363 A | 4/2006 |
| GB | 2 434 166 A | 7/2007 |

OTHER PUBLICATIONS

European Search and Examination Report received in application No. GB 0917053.1 dated Oct. 28, 2009.
Oceaneering International, Inc.; "Control Line Filtration Systems;" Product Information Brochure, dated Apr. 2006.
European Search and Examination Report received in application No. GB0810130.5 dated Jul. 28, 2008.

* cited by examiner

*Primary Examiner*—Kenneth Thompson
(74) *Attorney, Agent, or Firm*—Wong, Cabello, Lutsch, Rutherford & Brucculeri LLP

(57) ABSTRACT

A control system for a surface controlled sub-surface safety valve has first and second control lines. The first control line communicates control fluid to the sub-surface safety valve and preferably has a sump and in-line filters. Hydraulic pressure applied to the safety valve with this first control line can open the safety valve. The second control line also communicates control fluid to the sub-surface safety valve and preferably has a sump. A connecting valve is connected between the first and second control lines. The connecting valve allows control fluid to communicate from the first control line to the safety valve but prevents fluid communication from the second control line to the first control line. To open the valve, the second control line is exhausted to a reservoir. The dual control lines provide redundant control of the safety valve and can also be cycled to remove debris from the system.

55 Claims, 4 Drawing Sheets

DUAL CONTROL LINE SYSTEM AND METHOD FOR OPERATING SURFACE CONTROLLED SUB-SURFACE SAFETY VALVE IN A WELL

FIELD OF THE DISCLOSURE

The subject matter of the present disclosure generally relates to a surface controlled sub-surface safety valve for a well and, more particularly, to a dual control line system for communicating control fluid to a sub-surface safety valve that is remotely controlled from the surface and that has a single line input for the control fluid.

BACKGROUND OF THE DISCLOSURE

In an oil and gas well, a sub-surface safety valve is a downhole valve normally maintained in an open position to allow fluid to flow through the valve. The safety valve is closed to prevent blowout of the well, for example, if an excessive pressure drop or flow occurs across the safety valve. One type of sub-surface safety valve uses a spring and choke mechanism to close the valve if the well flow rate exceeds a predetermined level. Another type uses a pre-charged chamber to close the valve if the pressure caused by increased flow falls below a predetermined value.

Yet another type of sub-surface safety valve is remotely controlled and is commonly referred to as a Surface Controlled Sub-surface Safety Valve (SCSSSV). FIG. 1 shows this type of sub-surface safety valve 10 connected to a tubing assembly 15 downhole. The valve 10 has a flap 18 that is normally biased to block an internal bore 11 of the safety valve 10. To open the flap 18, a single control line 20 communicates hydraulic pressure from a well control panel (not shown) at the surface to a control port 12 of the valve 10. The hydraulic pressure pushes a piston 13 and moves an internal sleeve 14 against a spring force 16 in the valve 10. When moved, the sleeve 14 causes the flap 18 to open so that fluid can pass through the internal bore 11 of the valve 10. To close the valve 10 in response to uncontrolled flow and/or pressure drop, the well control panel at the surface removes the hydraulic pressure applied at the port 12, and the spring force 16 moves the internal sleeve 14, causing the flap 18 to close off the bore 11.

The control line 20, which may be ¼-inch diameter tubing, can fail due to various reasons, which may make the valve 10 inoperable. For example, the control line 20 over time may become contaminated or blocked due to debris in the control fluid. Typical debris, contamination, or particles that can develop and become suspended in the control fluid can come from reservoirs, physical wear of system components, chemical degradation, and other sources. Therefore, it is known in the art to use a filtering system with the control line 20 due to the importance of the safety valve 10.

FIG. 2 shows an existing filtering system used for the control line 20 connected to a sub-surface safety valve 10. The filtering system includes a sump 30 and in-line filter 40. The sump 30 can collect debris contained in the control fluid, and the in-line filter 40 can remove debris from the control fluid. Unfortunately, the existing filtering system can offer less than ideal filtering of the control fluid and may not ensure reliable operation of the safety valve 10. For example, the in-line filter 40 has a tendency to become blocked once it eventually becomes saturated with debris, which can make the safety valve 10 inoperable and can require the filter 40 to be replaced. Moreover, any problems with the control line 20 caused by debris or contamination can render the valve 10 inoperable or may require repairs.

Accordingly, what is needed is a system that can improve the collection of debris and filtering of debris in control fluid communicated to a surface controlled sub-surface safety valve and that can increase the reliability of the safety valve's operation. The subject matter of the present disclosure is directed to overcoming, or at least reducing the effects of, one or more of the problems set forth above.

SUMMARY OF THE DISCLOSURE

A dual control line system is used for a surface controlled sub-surface safety valve. In the dual control line system, first and second control lines communicate control fluid to the same control port of the sub-surface safety valve. The first control line preferably has a sump component to collect debris from the control fluid and has one or more in-line filters to filter debris from the control fluid. Preferably, the second control line also has a sump component to collect debris but may not have any in-line filters in one embodiment. A connecting valve is connected between the first and second control lines. The connecting valve allows control fluid to communicate from the first control line to the safety valve but prevents fluid communication from the second control line to the first control line. To open the valve, a well control panel applies hydraulic pressure to the safety valve via the first control line. To close the valve, the well control panel exhausts the hydraulic pressure to a reservoir via the second control line. Use of the dual control lines, sumps, and filters allows control fluid to migrate through the system and can reduce the debris and contamination in the control fluid. In addition, the dual control line system can be cycled to remove debris from the system. Furthermore, the dual control lines provide redundant control of the safety valve if one of the control lines becomes blocked or damage.

DETAILED DESCRIPTION

Figure 1:
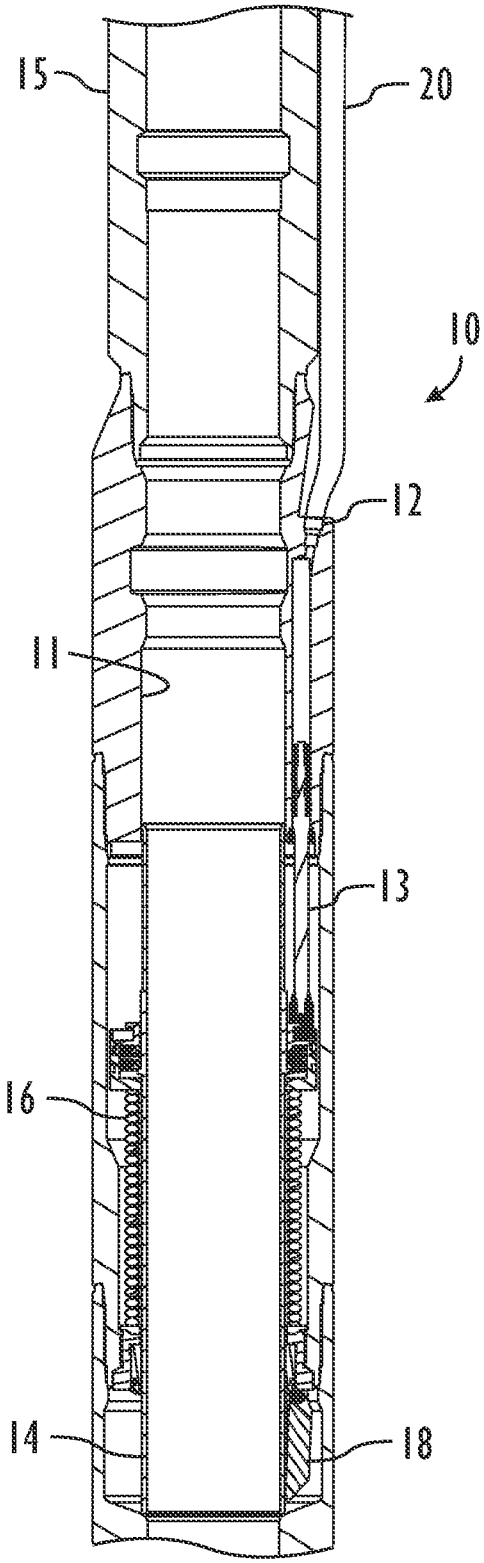
FIG. 1 (Prior Art)
FIG. 1 illustrates a surface controlled sub-surface safety valve according to the prior art.
Figure 2:
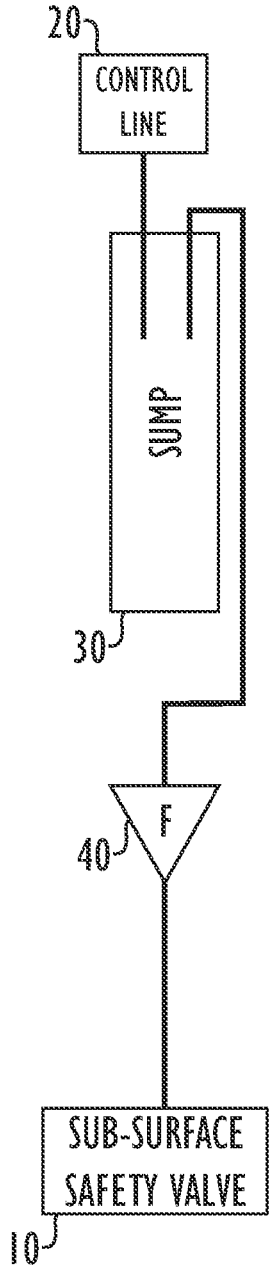
FIG. 2 (Prior Art)
FIG. 2 illustrates a filtering system according to the prior art for the sub-surface safety valve.
Figure 3:
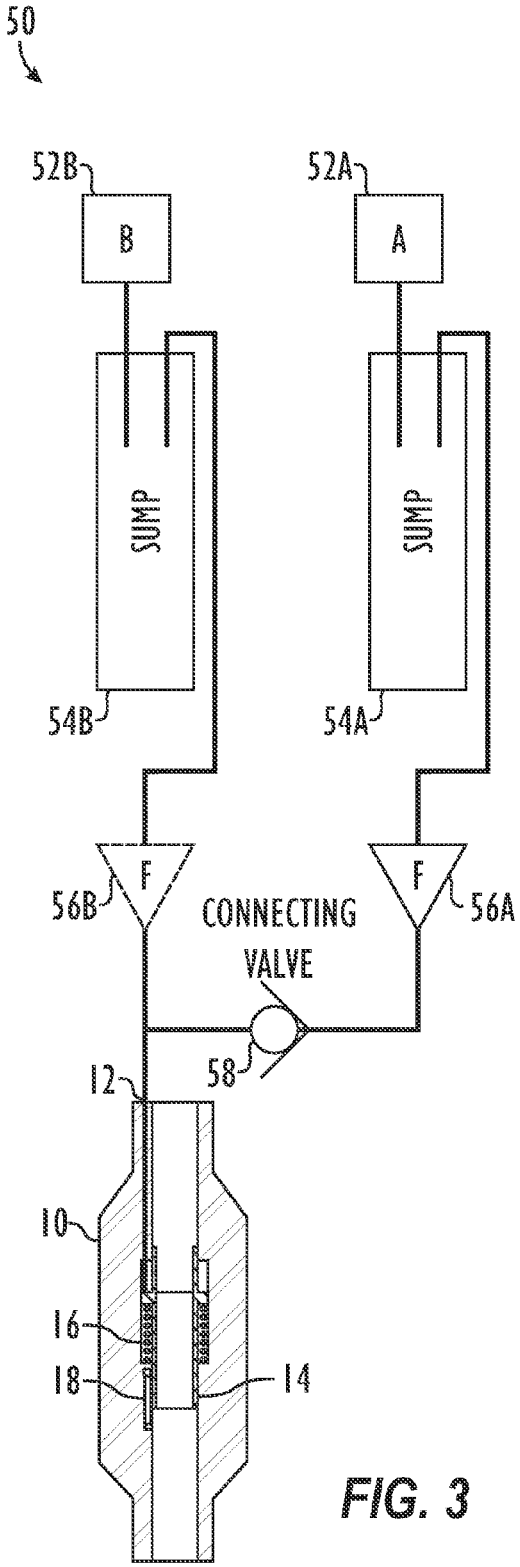
FIG. 3 illustrates one embodiment of a dual control line system for a surface controlled sub-surface safety valve according to certain teachings of the present disclosure.

FIG. 3 illustrates one embodiment of a dual control line system 50 for a surface controlled sub-surface safety valve ("safety valve") 10. The system 50 includes first and second control lines 52A-B interconnected to one another by a one-way connecting valve 58 and connected to a single control port 12 of the safety valve 10. With the two control lines 52A and 52B run from the surface to the safety valve 10, one of the control lines 52A can power the safety valve 10 open while the second control line 52B can be used to close the valve 10.

In particular, the first control line 52A is the main line used to power the safety valve 10 hydraulically to the open position. To open the valve, for example, a wellhead control panel (not shown) at the surface applies hydraulic pressure to the control port 12 via control fluid in the first control line 52A. The well control panel can include any conventional device at the surface used to operate a sub-surface safety valve or the like via control lines and fluids. The hydraulic pressure moves the internal sleeve 14 against the spring force 16. When sufficiently moved, the internal sleeve 14 opens the flap 18 that normally blocks the internal bore 11 of the safety valve 10. To close the safety valve 10, the wellhead control panel exhausts the second control line 52B to a fluid reservoir (not shown), allowing the release of hydraulic pressure of the control fluid. The release allows the spring force 16 to move the internal sleeve 14 and permits the flap 18 to close the bore 11.

The dual control line system 50 offers a number of advantages for operating the safety valve 10. For example, the dual control lines 52A-B provide redundant control of the safety valve 10. If the first control line 52A breaks or becomes blocked due to debris, then the second control line 52B can be used as a redundant line to open and close the safety valve 10. In such a situation, the wellhead control panel can apply hydraulic pressure to the control port 12 via the second control line 52B. The one-way connecting valve 58 prevents the control fluid in the second control line 52B from entering into the first control line 52A. Thus, even if the first control line 52A becomes clogged or broken, the second control line 52B can still be used to operate the valve 10 because the connecting valve 58 can block off communication with the first control line 52A.

In another advantage, the dual control line system 50 can aid in keeping the control fluid substantially clean of debris and can reduce the potential for blockage. For example, the first control line 52A preferably has a sump 54A to collect debris and has one or more in-line filters 56B to filter debris from the control fluid. The second control line 52B can also have a sump and one or more in-line filters 56B. During use, control fluid and associated debris is allowed to migrate through the system 50 so that the potential for blockage can be reduced. In addition, operators can cycle the safety valve 10 open and closed by applying control fluid with the first control line 52A and exhausting the control fluid with the second line 52B. This cycling can act to flush the system 50 of debris and contaminants. For example, the second sump 54B used to collect debris in the second control line 52B can be flushed of debris so that potential blockage of the filter 56B can be minimized and the filter 56B can remain cleaner for longer periods of time.

Figure 4:
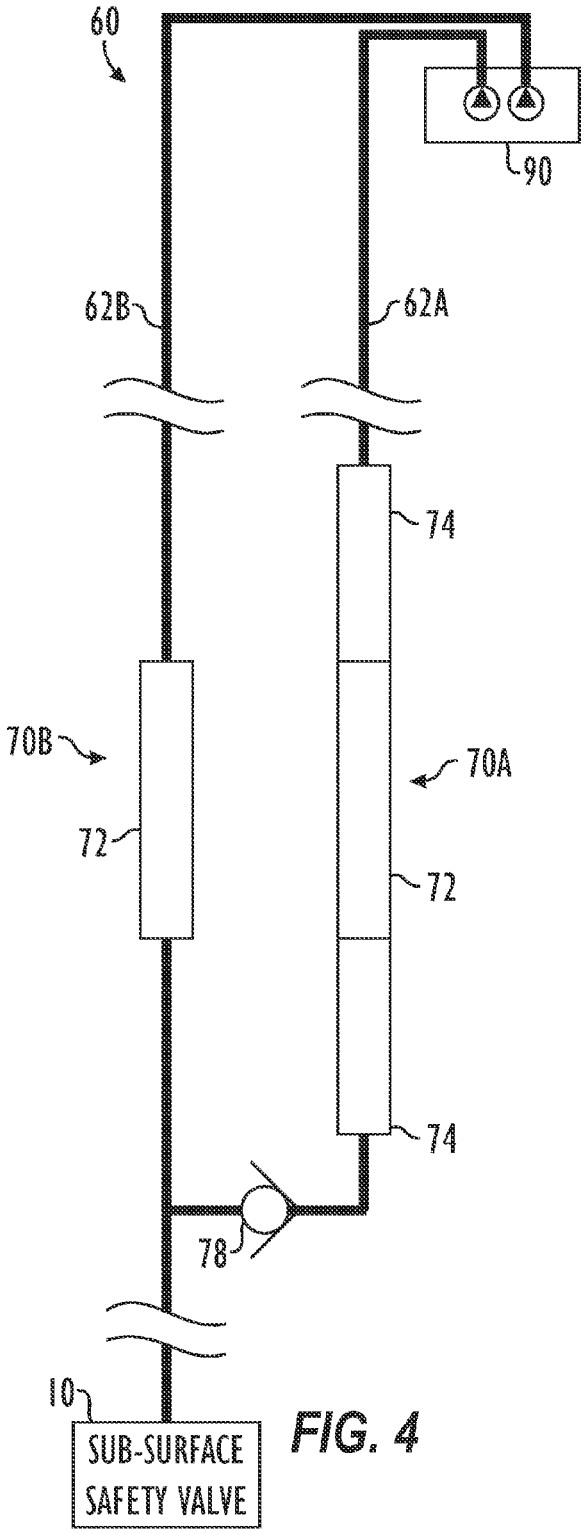
FIG. 4 illustrates another embodiment of a dual control line system having sump-filter assemblies according to certain teachings of the present disclosure.

FIG. 4 illustrates another embodiment of a dual control line system 60 having sump-filter assemblies 70A-B according to certain teachings of the present disclosure. As before, the dual control line system 60 has first and second control lines 62A-B for communicating control fluid from a well control panel or similar apparatus 90 at the surface to the safety valve 10 downhole. The first, main control line 62A has a first sump-filter assembly 70A that includes a sump component 72 and one or more in-line filter components 74. The second control line 62B has a second sump-filter assembly 70B and is connected to the first control line 62A by a one-way connecting valve 78. As shown, the second assembly 70B includes a sump component 72 but does not include any in-line filter components.

During operation, the well control panel 90 is operable to communicate control fluid to the sub-surface safety valve 10 via the first control line 62A to open the safety valve 10. During this procedure, the well control panel 90 maintains the second line 62B closed at the wellhead to prevent exhausting of control fluid through it. Using techniques known in the art, the well control panel 90 monitors flowline pressure sensors and automatically closes the safety valve 10 in response to an alarm condition requiring shut-in. To close the safety valve 10, the well control panel 90 removes the hydraulic pressure applied to the safety valve 10 by exhausting the control fluid from the valve 10 via the second control line 62B, recalling that the connecting valve 78 prevents control fluid from migrating back up through the first control line 62A. Likewise, the well control panel 90 is operable to communicate control fluid to the safety valve 10 via the second control line 62B to open the safety valve 10 in the event the first control line 62A is blocked or damaged.

As before, the assemblies 70A-B can keep the control fluid substantially free of debris and contamination. In addition, the well control panel 90 can cycle control fluid through the system 60 by repeatedly opening and closing the safety valve 10 as discussed previously so that the cycling can substantially flush debris from at least the second control line 62B. If the system 60 is intended to be flushed of debris by cycling the safety valve 10, then not including any in-line filter components 74 on the second line 62B may be preferred because including an in-line filter on the second control line 62B may prevent sufficient flushing of debris.

Figure 5A:
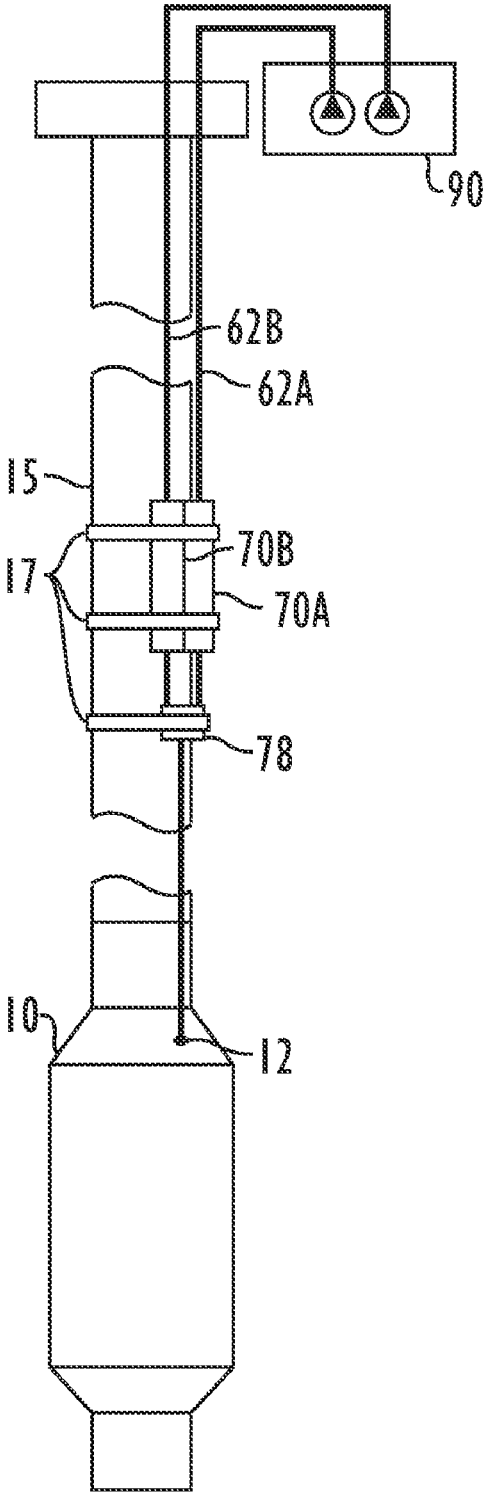
FIGS. 5A-5B illustrate embodiments of how components of the dual control line system of FIG. 4 can be connected to the safety valve.

The sump-filter assemblies 70A-B can be positioned in various places along the control lines 62A-B as they run from the surface along the tubing to the sub-surface safety valve 10. In general, they can be positioned anywhere between the wellhead and the safety valve 10. FIG. 5A shows one arrangement of how the sump-filter assemblies 70A-B and connecting valve 78 can be attached to tubing 15 above the safety valve 10. In this embodiment, the components are attached by straps or bandings 17 known in the art that are typically used to strap control lines to tubing 15.

Figure 5B:
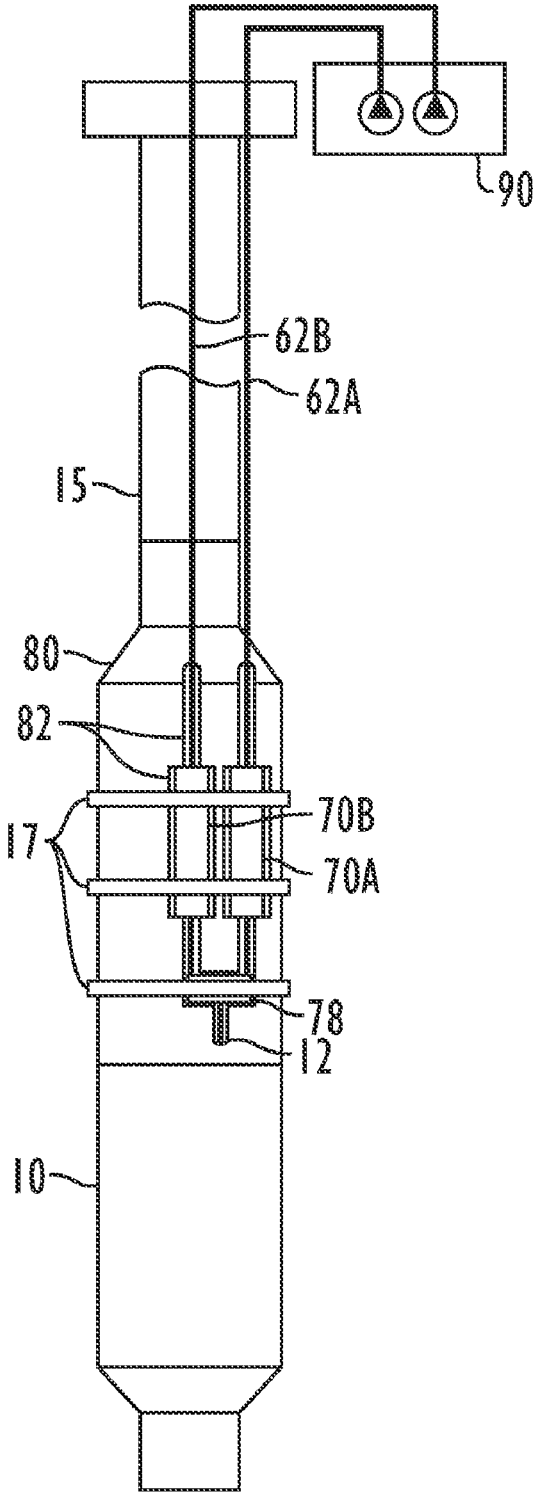

FIG. 5B shows another arrangement that uses an independent sub-assembly 80 to house the sump-filter assemblies 70A-B and the connecting valve 78. The sub-assembly 80 is connected between the tubing 15 and the safety valve 10 and defines wells 82 in its outside surface to accommodate the components. Again, bandings 17 or other devices can be used to hold the components in the wells 82 of the sub-assembly 80. In addition to the arrangements shown in FIGS. 5A-5B, one skilled in the art will appreciate that other arrangements can be used to attach the sump-filter assemblies 70A-B and connecting valve 78 to the tubing 15 and/or the safety valve 10.

The system 60 can use any suitable in-line filter components 74 known in the art. For example, the filter component 74 can be a high pressure filter capable of providing anywhere from 2 to 20 micron filtration of hydraulic fluids and that can use a wire mesh media, sintered metal, or the like as the filter media. The in-line filter components 74 can also be connected in series along the control line before, after, or both before and after the sump component 72. Furthermore, any multiple in-line filter components 74 can have different degrees of micron filtration as desired. One example of a suitable filter component 74 is 50 micron available from Nova Technology. The one-way connecting valve 78 used for the system 60 can include any suitable one-way valve known in the art for downhole hydraulic control lines. One example of a suitable connecting valve 78 is Parker C-Series Check Valve part no. 2F-C2L-* available from Parker Hannifin Corporation.

Figure 6A:
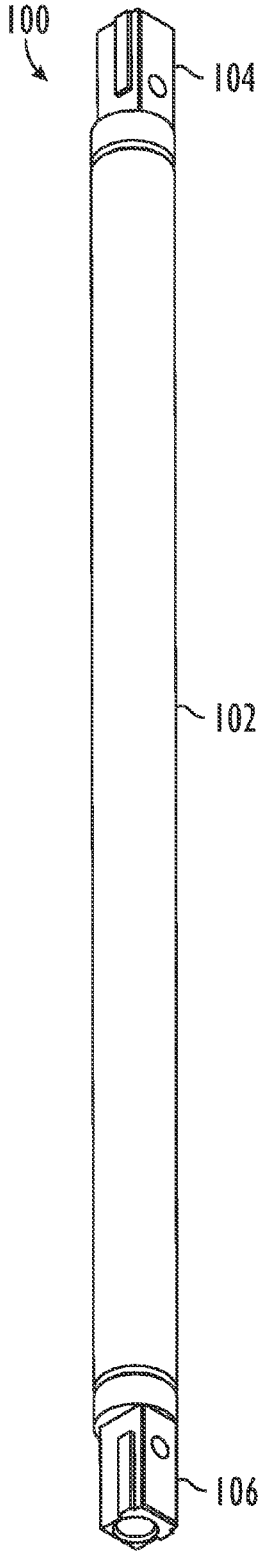
FIG. 6A illustrates a perspective view of one embodiment of a sump component for use in the dual control line system of FIG. 4.
Figure 6B:
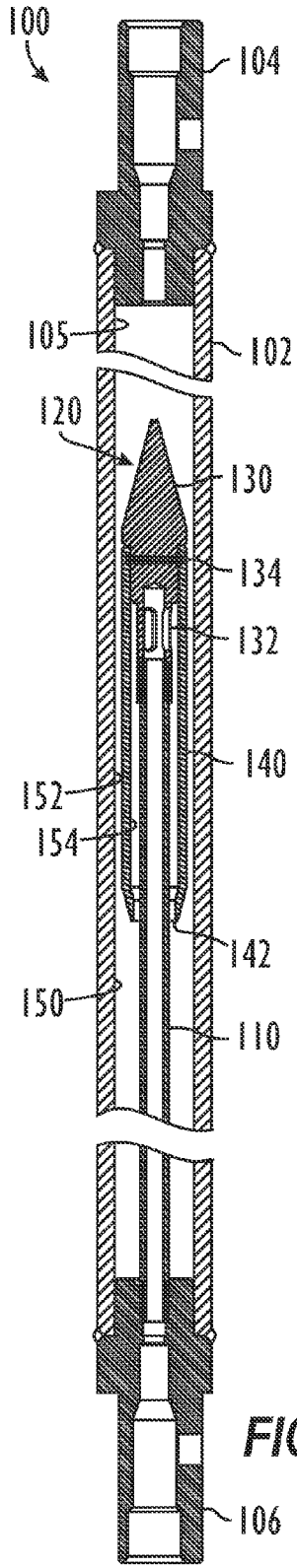
FIG. 6B illustrates a cross-sectional view of the sump component of FIG. 6A.

Because the sumps-filter assemblies 70A-B can be positioned near the safety valve 10 at the bottom of the tubing string 15, the sump components 72 are preferably capable of operating at a grade or tilt, for example, when the wellbore is horizontal or non-vertical. FIGS. 6A-6B show one embodiment of a sump component 100 that can be used in the dual control line system 60 of FIG. 4 and that is also capable of operating at some degree of grade.

The sump component 100 has a tubular housing 102. Port members 104 and 106 are attached (i.e., welded) to the opposing ends of the tubular housing 102 to create a chamber 105 within the component 100. These port members 104 and 106 have ports for communicating control fluid with other components of the system, such as in-line filters and control lines. A filter tube 110 is disposed within the chamber 105 and has its proximate end connected to the bottom port member 106. The distal end of the tube 110 extends approximately halfway into the chamber 105, creating an annulus 150 at the lower half of the housing 102 in which to collect potential debris in the control fluid.

A diverter body 120 is attached to the distal end of the tube 110. To divert control fluid communicated from the top port member 104, the body 120 has a cone-shaped diverter head 130 and a sleeve 140. The diverter head 130 is attached to the distal end of the filter tube 110 and has openings 132 on its underside that communicate with the tube 110 to allow control fluid to communicate between the annulus 150 and the tube 110. The sleeve 140 is substantially tubular and has a proximate end connected to the diverter head 130 by a spring pin 134. The tubular body of the sleeve 140 extends over the openings 132 and along a portion of the tube 110, dividing part of the annulus 150 into an inner annulus portion 152 and an outer annulus portion 154. Preferably, the opening 142 at the distal end of the sleeve 140 has a smaller diameter than a central diameter of the rest of the sleeve 140.

In use, control lines or filter components may be coupled to the port members 104 and 106. Control fluid to the top port member 104 may come from the well control panel, while control fluid may communicate to the safety valve from the bottom port member 106. When hydraulic pressure is applied at the top port member 104, the control fluid migrates into the chamber 105 and down around the filter diverter head 130. Passing the diverter head 130, the control fluid is driven along the sleeve 140 in the outer annulus portion 152 until it migrates to the bottom annulus 150 of the chamber 105. Making the control fluid travel outside of the diverter body 120 may tend to force debris and contamination out of the control fluid and to accumulate at the bottom of the chamber 105. As it further migrates, the control fluid is allowed to travel through the smaller diameter opening 142 of the sleeve 140 and into the inner annulus portion 154. Eventually, the control fluid can enter the openings 132, then travel through the filter tube 110, and then pass out the bottom port member 106 to reach the safety valve.

Figure 6C:
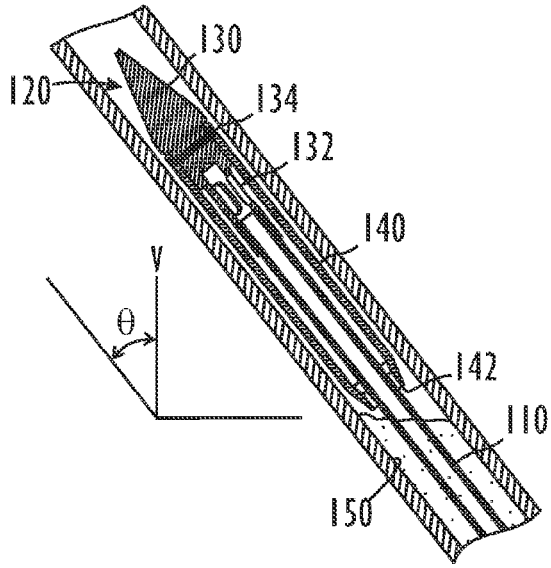
FIG. 6C illustrates a portion of the sump component of FIG. 6A oriented at a grade.

With the above arrangement in the sump component 100, the debris will tend to settle to the bottom annulus 150 of the chamber 105. If the component 100 is at a grade (i.e., is non-vertical), the diverter body 120 will tend to keep the collected debris from inadvertently migrating out of the sump component 100 via the top port member 102 and will tend to keep the debris from entering through the opening 142 of the sleeve 140 to the openings 132 and tube 110. For example, as shown in the partial view of FIG. 6C, collected debris—even though it nearly fills the entire lower annulus 150—can be substantially prevented by the diverter body 120 from reaching the openings 132 and the end of the tube 110 when the component 100 is at a grade θ in a non-vertical portion of a wellbore.

In one embodiment, the sump component 100 is approximately 22-inches long and has a diameter of about 1-inch. These dimensions can make it well suited for being strapped outside tubing, a sub-assembly housing, and/or part of a safety valve. Because the sump component 100 is used in a well, the housing 102 and port members 104 and 106 are preferably composed of a nickel-chromium alloy. The filter tube 110, diverter head 130, and sleeve 140 are preferably made of nickel-based alloy. Other suitable materials could also be used.

The sump component 100 can be used for both control lines 62A-B of the disclosed dual control line system 60 (See FIG. 4). If the sump component 100 is being used in the second assembly 70B of the system 60 of FIG. 4, for example, then a flushing operation performed when exhausting the component 100 preferably allows debris from the bottom of the chamber 105 to be forced out of the chamber 105 via the top port member 104. In addition, the sump component 100 can be used in implementations where only a single control line from a well control panel communicates control fluid to a sub-surface safety valve having a single control port.

Not only is the sump component 100 useful for a sub-surface safety valve, but the inventive sump component 100 can be used in other control line applications in a well and especially when the wellbore has a grade. In just one example, the inventive sump component 100 can be used on control lines for packers or other subsurface tools that are hydraulically controlled from the surface.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A control system for operating a sub-surface safety valve, comprising:

a first control line assembly in fluid communication with a control port of the sub-surface safety valve;

a second control line assembly in fluid communication with the control port of the sub-surface safety valve; and a valve interconnecting the first and second control line assemblies, the valve allowing fluid communication from the first control line assembly to the control port and preventing fluid communication from the second control line assembly to the first control line assembly, wherein operated in a first mode, the control system communicates control fluid to the sub-surface safety valve via the first control line assembly to open the sub-surface safety valve and exhausts the control fluid from the sub-surface safety valve via the second control line assembly to close the sub-surface safety valve, and wherein operated in a second mode, the control system communicates the control fluid to the sub-surface safety valve via the second control line assembly to open the sub-surface safety valve.

2. The system of claim 1, wherein at least one of the first and second control line assemblies comprises a sump in fluid communication with the at least one control line assembly to collect debris from the control fluid.

3. The system of claim 2, wherein the sump comprises:

a housing defining a chamber and having first and second ports at opposing ends of the chamber;

a tube positioned in the chamber and defining an internal bore, the tube having a proximate end connected to the second port and having a distal end disposed in the chamber; and a body being substantially tubular and positioned at least partially in the annulus between the chamber and the tube, the body having an open end and a closed end, the open end permitting control fluid to communicate between an inside of the body and the annulus, the closed end connected to the distal end of the tube, at least one opening being defined at the connection of the closed end and the tube to permit communication of control fluid between the inside of the body and the internal bore of the tube.

4. The system of claim 1, wherein at least one of the first and second control line assemblies comprises at least one filter in fluid communication with the at least one control line assembly to filter debris from the control fluid.

5. The system of claim 1, wherein portions of the first and second control line assemblies are banded to tubing components connected to the sub-surface safety valve.

6. The system of claim 1, further comprising a housing sub-assembly connected adjacent the sub-surface safety valve and defining wells in an exterior surface for accommodating at least some portion of the first and second control line assemblies.

7. The system of claim 1, further comprising a fluid control apparatus controlling the control fluid for the first and second control line assemblies.

8. The system of claim 7, wherein the fluid control apparatus is operable to communicate the control fluid to the sub-surface safety valve via the first control line assembly to open the safety valve.

9. The system of claim 8, wherein the fluid control apparatus is operable to exhaust the control fluid from the sub-surface safety valve via the second control line assembly to close the safety valve.

10. The system of claim 8, wherein the fluid control apparatus is operable to cycle the control fluid through the control system to substantially flush debris from at least the second control line assembly.

11. The system of claim 8, wherein the fluid control apparatus is operable to communicate control fluid to the sub-surface safety valve via the second control line assembly to open the safety valve.

12. The system of claim 11, wherein the fluid control apparatus is operable to use the second control line assembly to open the safety valve if the first control line assembly becomes blocked or damaged.

13. A method of operating a sub-surface safety valve in a wellbore, comprising:

operating the safety valve in a first mode of operation with a control system comprising:

opening the safety valve by communicating hydraulic pressure to a control port of the safety valve via a first control line, and closing the safety valve by exhausting hydraulic pressure from the control port of the safety valve via a second control line; and operating the safety valve in a second mode of operation with the control system comprising opening the safety valve by communicating hydraulic pressure to the safety valve via the second control line.

14. The method of claim 13, wherein communicating hydraulic pressure comprises collecting at least some debris from control fluid communicated in the first control line.

15. The method of claim 14, wherein collecting at least some debris comprises preventing migration of the collected debris even at a grade.

16. The method of claim 13, wherein communicating hydraulic pressure comprises filtering at least some debris from control fluid communicated in the first control line.

17. The method of claim 13, wherein opening the safety valve by communicating hydraulic pressure to the control port via the second control line comprises preventing fluid communication from the second control line to the first control line.

18. The method of claim 17, wherein opening the safety valve with the second control line is performed if the first control line becomes blocked or damaged.

19. The method of claim 13, further comprising cycling control fluid through the first and second control lines to substantially flush debris from at least the second control line.

20. A control line sump, comprising:

a housing defining a chamber for control fluid and having first and second ports at opposing ends of the chamber;

a tube positioned in the chamber and defining an internal bore, the tube having a proximate end connected to the second port and having a distal end disposed in the chamber; and a body being substantially tubular and positioned at least partially in the annulus between the chamber and the tube, the body having an open end and a closed end, the open end permitting control fluid to communicate between an inside of the body and the annulus, the closed end connected to the distal end of the tube, at least one opening being defined at the connection of the closed end and the tube to permit communication of control fluid between the inside of the body and the internal bore of the tube, wherein the sump collects debris in the annulus between the chamber and the tube.

21. The apparatus of claim 20, wherein the body substantially prevents collected debris from migrating from the annulus to the tube when the sump is oriented at a grade from vertical.

22. The apparatus of claim 20, wherein the distal end of the tube is disposed approximately halfway in the chamber.

23. The apparatus of claim 20, wherein the body comprises a head having first and second ends, the first end disposed in the chamber toward the first port of the housing, the second end connected to the distal end of the tube and defining the at least one opening.

24. The apparatus of claim 23, wherein the first end of the head is substantially pointed to divert flow of the control fluid.

25. The apparatus of claim 23, wherein the body comprises a tubular sleeve having first and second ends, the first end attached to the head, the tubular sleeve extending along a length of the tube and separating the annulus between the tube and the chamber into an outer annulus and an inner annulus, the second end defining a smaller diameter opening than a central diameter of the tubular sleeve.

26. The apparatus of claim 20, wherein first port communicates with at least one in-line filter for filtering the control fluid.

27. The apparatus of claim 20, wherein the second port communicates with at least one in-line filter for filtering the control fluid.

28. The apparatus of claim 20, wherein the first port receives control fluid communicated from a fluid control apparatus.

29. The apparatus of claim 20, wherein the second port communicates control fluid to a sub-surface device in a wellbore.

30. The apparatus of claim 29, wherein the sub-surface device is a sub-surface safety valve.

31. The apparatus of claim 20, wherein the housing comprises:

a cylindrical body having first and second open ends;

a first port member defining the first port and attached to the first open end; and a second port member defining the second port and attached to the second open end.

32. A control system for operating a sub-surface safety valve, comprising:

a first control line assembly in fluid communication with a control port of the sub-surface safety valve;

a second control line assembly in fluid communication with the control port of the sub-surface safety valve; and a valve interconnecting the first and second control line assemblies, the valve allowing fluid communication from the first control line assembly to the control port and preventing fluid communication from the second control line assembly to the first control line assembly, wherein the second control line assembly comprises a sump in fluid communication with a second control line to collect debris from control fluid.

33. The system of claim 32, wherein the first control line assembly comprises a sump in fluid communication with a first control line to collect debris from control fluid.

34. The system of claim 32, wherein at least one of the first and second control line assemblies comprises at least one filter in fluid communication with the at least one control line assembly to filter debris from the control fluid.

35. The system of claim 32, further comprising a fluid control apparatus being operable to exhaust the control fluid from the sub-surface safety valve via the second control line assembly to close the sub-surface safety valve.

36. The system of claim 32, further comprising a fluid control apparatus being operable to communicate the control fluid to the sub-surface safety valve via the second control line assembly to open the sub-surface safety valve.

37. The system of claim 36, wherein the fluid control apparatus uses the second control line assembly to open the sub-surface safety valve if the first control line assembly becomes blocked or damaged.

38. A control system for operating a sub-surface safety valve, comprising:

a first control line assembly in fluid communication with a control port of the sub-surface safety valve;

a second control line assembly in fluid communication with the control port of the sub-surface safety valve; and a valve interconnecting the first and second control line assemblies, the valve allowing fluid communication from the first control line assembly to the control port and preventing fluid communication from the second control line assembly to the first control line assembly, wherein portions of the first and second control line assemblies are banded to tubing components connected to the sub-surface safety valve.

39. The system of claim 38, wherein at least one of the first and second control line assemblies comprises a sump in fluid communication with the at least one control line assembly to collect debris from control fluid.

40. The system of claim 38, wherein at least one of the first and second control line assemblies comprises at least one filter in fluid communication with the at least one control line assembly to filter debris from the control fluid.

41. The system of claim 38, further comprising a fluid control apparatus being operable to exhaust the control fluid from the sub-surface safety valve via the second control line assembly to close the sub-surface safety valve.

42. The system of claim 38, further comprising a fluid control apparatus being operable to communicate the control fluid to the sub-surface safety valve via the second control line assembly to open the sub-surface safety valve.

43. The system of claim 42, wherein the fluid control apparatus uses the second control line assembly to open the sub-surface safety valve if the first control line assembly becomes blocked or damaged.

44. A control system for operating a sub-surface safety valve, comprising:

a first control line assembly in fluid communication with a control port of the sub-surface safety valve;

a second control line assembly in fluid communication with the control port of the sub-surface safety valve;

a valve interconnecting the first and second control line assemblies, the valve allowing fluid communication from the first control line assembly to the control port and preventing fluid communication from the second control line assembly to the first control line assembly; and a housing sub-assembly connected adjacent the sub-surface safety valve and defining wells in an exterior surface for accommodating at least some portion of the first and second control line assemblies.

45. The system of claim 44, wherein at least one of the first and second control line assemblies comprises a sump in fluid communication with the at least one control line assembly to collect debris from control fluid.

46. The system of claim 44, wherein at least one of the first and second control line assemblies comprises at least one filter in fluid communication with the at least one control line assembly to filter debris from the control fluid.

47. The system of claim 44, further comprising a fluid control apparatus being operable to exhaust the control fluid from the sub-surface safety valve via the second control line assembly to close the sub-surface safety valve.

48. The system of claim 44, further comprising a fluid control apparatus being operable to communicate the control fluid to the sub-surface safety valve via the second control line assembly to open the sub-surface safety valve.

49. The system of claim 48, wherein the fluid control apparatus uses the second control line assembly to open the sub-surface safety valve if the first control line assembly becomes blocked or damaged.

50. A control system for operating a sub-surface safety valve, comprising:

a first control line assembly in fluid communication with a control port of the sub-surface safety valve;

a second control line assembly in fluid communication with the control port of the sub-surface safety valve;

a valve interconnecting the first and second control line assemblies, the valve allowing fluid communication from the first control line assembly to the control port and preventing fluid communication from the second control line assembly to the first control line assembly; and a fluid control apparatus controlling control fluid for the first and second control line assemblies, the fluid control apparatus being operable to:

communicate the control fluid to the sub-surface safety valve via the first control line assembly to open the sub-surface safety valve, and cycle the control fluid through the control system to substantially flush debris from at least the second control line assembly.

51. The system of claim 50, wherein at least one of the first and second control line assemblies comprises a sump in fluid communication with the at least one control line assembly to collect debris from the control fluid.

52. The system of claim 50, wherein at least one of the first and second control line assemblies comprises at least one filter in fluid communication with the at least one control line assembly to filter debris in the control fluid.

53. The system of claim 50, wherein the fluid control apparatus is operable to exhaust the control fluid from the sub-surface safety valve via the second control line assembly to close the sub-surface safety valve.

54. The system of claim 50, wherein the fluid control apparatus is operable to communicate the control fluid to the sub-surface safety valve via the second control line assembly to open the sub-surface safety valve.

55. The system of claim 54, wherein the fluid control apparatus uses the second control line assembly to open the sub-surface safety valve if the first control line assembly becomes blocked or damaged.

* * * * *